US005095820A

United States Patent [19]

Klappenecker

[11] Patent Number: 5,095,820

[45] Date of Patent: Mar. 17, 1992

[54] PRINTING UNIT INCLUDING AN INKING ASSEMBLY

[75] Inventor: Karl Klappenecker, Konstanz, Fed. Rep. of Germany

[73] Assignee: Licentia Patent-Verwaltungs-GmbH, Frankfurt am Main, Fed. Rep. of Germany

[21] Appl. No.: 630,973

[22] Filed: Dec. 24, 1990

[30] Foreign Application Priority Data

Dec. 22, 1989 [DE] Fed. Rep. of Germany ..... 3942525

[51] Int. Cl.[5] ..... B41F 31/06; B41F 31/16; B41L 27/18

[52] U.S. Cl. ..... 101/350; 101/DIG. 33

[58] Field of Search ..... 101/348, 349, 350, 351, 101/363, 364, DIG. 32, DIG. 38, DIG. 33, 206-210, 148, DIG. 48

[56] References Cited

U.S. PATENT DOCUMENTS 2,719,484 10/1955 Wardell et al. ..... 101/DIG. 33
4,824,514 4/1989 Schneider ..... 101/DIG. 33
4,987,831 1/1991 Weber ..... 101/DIG. 32

FOREIGN PATENT DOCUMENTS 3419764 11/1985 Fed. Rep. of Germany ... 101/DIG. 32
0066969 4/1982 Japan ..... 101/DIG. 38

*Primary Examiner*—J. Reed Fisher
*Attorney, Agent, or Firm*—Spencer & Frank

[57] ABSTRACT

A printing unit for providing ink imprints includes a printing member and an inking assembly supplying ink to the printing member. The inking assembly comprises an ink reservoir; an endless flexible ink carrying element; a support for positioning the element such that a first part of the element extends into the ink reservoir and a second part of the element is situated externally of the ink reservoir; a drive for circulating the element, whereby the element carries ink out of the reservoir; and an element-contacting roller having a cylindrical surface positioned to be in contact with the second part of the element for receiving ink therefrom.

11 Claims, 1 Drawing Sheet

PRINTING UNIT INCLUDING AN INKING ASSEMBLY

CROSS REFERENCE TO RELATED APPLICATION

This application claims the priority of Federal Republic of Germany Application No. P 39 42 525.8 filed Dec. 22, 1989, which is incorporated herein by reference.

BACKGROUND OF THE INVENTION

This invention relates to a printing unit which includes an inking assembly, particularly a printing unit which has, as its printing member, a rotary stamp for cancelling mail.

The inking of a printing member, such as a rotary stamp, is conventionally effected by transferring ink from a felt roller being in tangential contact with the printing member. Printing units having a simple inking member of this type have several disadvantages. Thus, the quality of ink print is often objectionable. The reason therefor resides in the fact that the felt roller is either non-driven or can be driven only at low rpm's otherwise the large centrifugal forces would expel ink from the felt material. Since, however, the rotary stamp is driven with an rpm of approximately 1400, there results a velocity difference between the stamp and the inking roller which, in turn, causes a removal (shaving off) of ink-loaded felt particles by the stamp, resulting in a smearing of the imprint. Further, because of the limited ink absorbing capacity of the felt layer, the felt roller has to be frequently inked. Further, a printing unit equipped with an inking assembly of this type provides gradually fading imprints until the periodic reinking of the felt roller is effected. It is a further disadvantage that in case the felt roller has a vertically oriented axis, the ink wanders downwardly by gravity, resulting in a non-uniform inking of the rotary stamp.

SUMMARY OF THE INVENTION

It is an object of the invention to provide an improved inking assembly which supplies ink from an ink reservoir in a simple, operationally reliable and accurately dosed manner to a printing stamp such as a rotary printing cylinder.

This object and others to become apparent as the specification progresses, are accomplished by the invention, according to which, briefly stated, the printing unit for providing ink imprints includes a printing member and an inking assembly supplying ink to the printing member. The inking assembly comprises an ink reservoir; an endless flexible ink carrying element; a support for positioning the element such that a first part of the element extends into the ink reservoir and a second part of the element is situated externally of the ink reservoir; a drive for circulating the element, whereby the element carries ink out of the reservoir; and an element-contacting roller having a cylindrical surface positioned to be in contact with the second part of the element for receiving ink therefrom.

The invention is thus based on the principle that ink is taken from a reservoir by an endless flexible element, such as a belt and carries the ink to a transfer roller with which the belt is at least approximately in a tangentially contacting relationship. Thus, ink that has adhered to the belt is being scraped off by and thus transferred to the cylindrical surface of the printing roller itself or a transfer roller of the printing unit.

According to an advantageous feature of the invention, the belt is formed of stranded stainless steel wire which, on the one hand, has a large capacity and, on the other hand, is chemically inert to all types of stamping inks and thus has a practically unlimited service life.

DESCRIPTION OF THE PREFERRED EMBODIMENT

Figure 1:
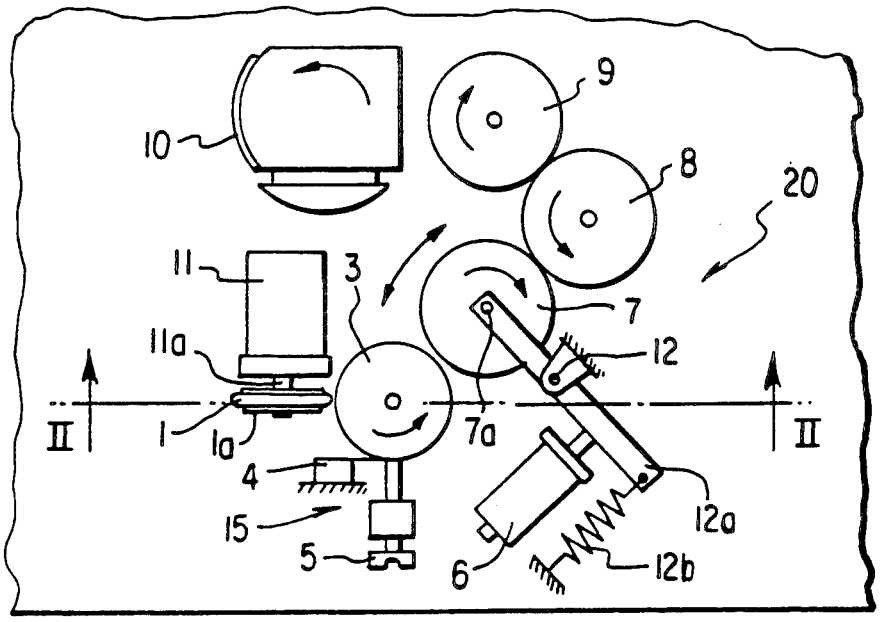
FIG. 1 is a schematic top plan view of a preferred embodiment of the invention.
Figure 2:
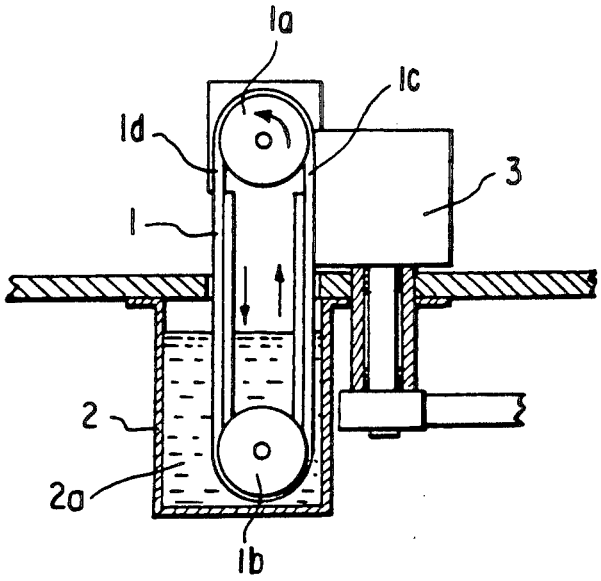
FIG. 2 is a schematic sectional view taken along line II—II of FIG. 1.

Turning now to FIGS. 1 and 2, an endless flexible element 1 in the form of a tension spring or a plastic belt is supported by end rollers 1*a* and 1*b* such that it is partially submerged in ink 2*a* held in an ink reservoir 2. The end rollers 1*a* and 1*b* divide the element 1 into flights 1*c* and 1*d*. The drive of the flexible element 1 is preferably effected by a motor 11 whose output shaft 11*a* carries the end roller 1*a* so that no sealing measures have to be taken to protect against the ink. As the flight 1*c* of the endless element 1, during its circulation about the end rollers 1*a*, 1*b*, emerges from the ink reservoir 2, it carries ink adhered to it towards a roller 3 of an ink reducing assembly 15 which also includes a doctor blade 4 for removing excess ink and an adjusting screw 5 for adjusting the doctor blade 4 relative to the surface of the roller 3. The outwardly-oriented face of the flight 1*c* of the belt 1 is in contact with the cylinder surface of the roller 3 along a generatrix thereof. As seen in FIG. 2, as the ink-carrying outwardly-oriented face of the flight 1*c* emerges from the reservoir, it is not contacted by any component (such as a support roller), but is immediately engaged by the roller 3 for transferring ink thereto.

An ink ductor assembly 20 includes an ink transfer roller 7 which oscillates about a shaft 12 between the belt-contacting roller 3 and a diametrically opposite drive roller 8 of the ink ductor assembly 20. Thus, the roller 7 transfers ink from the roller 3 to the roller 8. To obtain a possibly uniform inking of the roller 8, the shaft 12 is oscillated—for example, by a wobble (swash) plate—perpendicularly to the plane of rotation of the roller 7, that is, parallel to the rotary axis 7*a* of the roller 7. The oscillating motion of the roller 7 about the shaft 12 is advantageously effected by a solenoid 6 which is connected with a rocker 12*a* supported by pivot shaft 12 and carrying the roller 7. When the solenoid 6 is energized, its armature pushes on the rocker 12*a* against the force of a return spring 12*b* thus causing a counterclockwise turning motion (as viewed in FIG. 1) of the rocker 12*a* whereby the roller 7 moves in the direction of the roller 3. Such a solenoid arrangement is advantageous as compared to a cam shaft/follower-actuated oscillation of the ink transfer roller 7 in that a more silent operation is ensured. The roller 7 is braked to the circumferential speed of the roller 3 when the solenoid 6 is energized for a duration of 20 ms.

The ink from the roller 8 is transferred to a rotary stamp 10 with the intermediary of a roller 9 of the ink ductor assembly 20.

The rotary stamp 10 is driven by a single-turn clutch and requires a full revolution for providing an imprint. The surface of the inking roller 9 is made of an elastic material to ensure a satisfactory inking of the engraved surface of the steel stamp 10. The drive roller 8 is driven by a slip clutch to prevent damages to the inking roller 9 by the rotary stamp 10. Such damage may occur if the stamp 10 is not in its illustrated position of rest, but stops, for example, 90° too far, in which case it contacts and brakes the roller 9. Upon such an occurrence, and before damage may take place the torque limitation of the settable slip clutch takes effect, whereby the driving roll 8 stops.

The rollers 7 and 9 are frictionally connected with the drive roller 8. The circumferential speed of the roller group 7, 8, 9 of the ink ductor assembly 20 corresponds to that of the rotary stamp 10.

In another, non-illustrated embodiment the flexible element (belt) transfers the ink from the ink reservoir to the surface of an inking roller of an ink ductor assembly which, in turn, transfers the ink to a roller of an ink reducing assembly.

It will be understood that the above description of the present invention is susceptible to various modifications, changes and adaptations, and the same are intended to be comprehended within the meaning and range of equivalents of the appended claims.

What is claimed is:

1. In a printing unit for providing ink imprints, including a printing member and an inking assembly supplying ink to the printing member; the improvement wherein said inking assembly comprises (a) an ink reservoir;

(b) an endless flexible ink carrying element;

(c) end rollers supporting and positioning the element such that part of the element extends into the ink reservoir and part of the element is situated externally of the ink reservoir; said end rollers dividing the element into first and second flights; said first flight having opposite first and second surfaces;

(d) drive means for circulating said element, whereby said element carries ink out of said reservoir on the surfaces of said first flight; and (e) an element-contacting roller having a cylindrical surface positioned to be in contact with said first surface of said first flight externally of the ink reservoir for receiving ink from said element; said first surface being free from being contacted between said reservoir and said element-contacting roller.

2. A printing unit as defined in claim 1, wherein said printing member comprises a rotary stamp receiving ink from said inking assembly.

3. A printing unit as defined in claim 1, wherein said element comprises a plastic belt.

4. A printing unit as defined in claim 1, wherein said inking assembly comprises an ink reducing unit and wherein said ink reducing unit includes said element-contacting roller and a doctor blade contacting said cylindrical surface for removing excess ink therefrom.

5. A printing unit as defined in claim 1, further comprising an ink ductor assembly including (a) a first ductor roller;

(b) a second ductor roller having a rotary axis and being situated between the element-contacting roller and the first ductor roller; and (c) oscillating means for oscillating said second ductor roller into and out of contact with the element-contacting roller and the first ductor roller in a plane oriented perpendicularly to said rotary axis for transferring ink from said element-contacting roller to said first ductor roller.

6. A printing unit as defined in claim 5, wherein said oscillating means comprises (a) a rocker having an end carrying said second ductor roller;

(b) means for pivotally supporting said rocker; and (c) solenoid actuating means for periodically imparting force pulses to said rocker to cause pivotal motion thereof.

7. A printing unit as defined in claim 1, wherein said element contacts the cylindrical surface along a generatrix thereof.

8. A printing unit as defined in claim 7, further comprising a doctor blade in contact with said cylindrical surface of said element-contacting roller for removing excess ink therefrom.

9. A printing unit as defined in claim 7, wherein said element-contacting roller is a ductor roller; further comprising an ink reducing assembly including an ink reducing roller receiving ink from said element-contacting roller and a doctor blade contacting said ink reducing roller for removing excess ink therefrom.

10. A printing unit as defined in claim 1, wherein said support means comprises two end rollers; said endless flexible ink carrying element being trained about said end rollers; and further wherein said drive means comprises a drive motor having an output shaft carrying one of said end rollers.

11. A printing unit is defined in claim 1, wherein said element is a tension spring trained about said end rollers; and further wherein a doctor blade is in contact with said cylindrical surface of said element-contacting roller for removing excess ink therefrom.

* * * * *